US008784134B2

(12) United States Patent
Wu et al.

(10) Patent No.: US 8,784,134 B2
(45) Date of Patent: Jul. 22, 2014

(54) CABLE CONNECTOR HAVING A GROUNDING METALLIC PLATE AND TAIL SECTIONS OF SELECTED GROUNDING TERMINALS CONNECTED TOGETHER

(71) Applicants: Jerry Wu, Irvine, CA (US); Jun Chen, Kunshan (CN)

(72) Inventors: Jerry Wu, Irvine, CA (US); Jun Chen, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 18 days.

(21) Appl. No.: 13/684,185

(22) Filed: Nov. 22, 2012

(65) Prior Publication Data

US 2013/0130549 A1 May 23, 2013

(30) Foreign Application Priority Data

Nov. 22, 2011 (CN) ..... 2011 1 0372636

(51) Int. Cl.
*H01R 13/648* (2006.01)

(52) U.S. Cl.
USPC ..... 439/607.05

(58) Field of Classification Search
CPC ..... H01R 23/005; H01R 23/688; H01R 23/6873; H01R 23/7073; H01R 13/514; H01R 13/518; H01R 13/74
See application file for complete search history.

(56) References Cited

U.S. PATENT DOCUMENTS

| | | | | |
|---|---|---|---|---|
| 6,736,676 | B2 * | 5/2004 | Zhang et al. | 439/607.22 |
| 6,746,278 | B2 * | 6/2004 | Nelson et al. | 439/607.07 |
| 7,390,220 | B1 * | 6/2008 | Wu | 439/607.06 |
| 7,462,071 | B1 * | 12/2008 | Wu | 439/607.05 |
| 7,632,155 | B1 * | 12/2009 | Wu | 439/660 |

* cited by examiner

*Primary Examiner* — Chandrika Prasad
(74) *Attorney, Agent, or Firm* — Wei Te Chung; Ming Chieh Chang

(57) ABSTRACT

A cable assembly comprises a housing defining a receiving space; a spacer assembled to a rear end of the housing; a plurality of terminals integrated with the spacer, and arranged into two rows and received into the housing. And each row of terminals comprises at least two grounding terminals and a connecting piece connecting with rear ends of at least two grounding terminals. A metallic plate is received into the spacer and contacted to the connecting piece. And a cable is electrically connected with the plurality of terminals.

20 Claims, 9 Drawing Sheets

CABLE CONNECTOR HAVING A GROUNDING METALLIC PLATE AND TAIL SECTIONS OF SELECTED GROUNDING TERMINALS CONNECTED TOGETHER

BACKGROUND OF THE INVENTION

1. Field of the Invention

The present invention generally relates to a cable assembly, and more particularly to a cable assembly for transmitting high-speed signal.

2. Description of Related Art

Usually, a personal computer (PC) or consumer electronics (CE) product has a display for displaying video, and a cable assembly is needed to connect an interface of the display and a control device. A display port connector may be an ideal input/output (I/O) port adapted for both PC and CE products. However, cross talk may occur at interface section of the display port connector, which in turn may influence the quality of signals.

For example, U.S. Pat. No. 7,390,220 disclose a cable assembly comprising an insulated housing defining a receiving space, a plurality of terminals arranged into an upper and a lower terminal rows and received in the insulated housing, a metallic shell surrounding the insulated housing, a metallic plate disposed between the upper terminal row and the lower terminal row, and a cable including a number of wires electrically connecting to the terminals and the metal plate. The plurality of terminals comprises several pair of signal terminals and grounding terminals. The metallic plate comprises a base portion and a number of tabs respectively extending upwardly and downwardly from a rear edge of the base portion and attached to the grounding terminal. Obviously, a width between two tail sections of two laterally outermost terminals is become large and two laterally outmost terminals are located adjacent to inner side of the metallic shell. In this design, for either row of terminals, there exists a laterally outermost terminal tail section which comes nearer to the metallic shell to such an extent making cable wire soldering thereto difficult or even resulting in short-circuiting of it with an immediate adjacent terminal tail section. In addition, the metallic plate defines a number of tabs respectively connected with grounding terminals. Thus, the metallic plate is complicated to manufactured.

An improved cable assembly having a different arrangement of terminals is desired.

SUMMARY OF THE INVENTION

Accordingly, an object of the present invention is to provide an cable assembly having new arrangement of the terminals to improve crosstalk performance.

In order to achieve the object set forth, a cable assembly in accordance with the present invention comprises a housing defining a receiving space; a spacer assembled to a rear end of the housing; a plurality of terminals integrated with the spacer, and arranged into two rows and received into the housing, and each row of terminals comprising at least two grounding terminals and a connecting piece connecting with rear ends of at least two grounding terminals; a metallic plate received into the spacer and contacted to the connecting piece; and a cable electrically connected with the plurality of terminals.

Other objects, advantages and novel features of the invention will become more apparent from the following detailed description when taken in conjunction with the accompanying drawings.

DETAILED DESCRIPTION OF THE INVENTION

Figure 1:
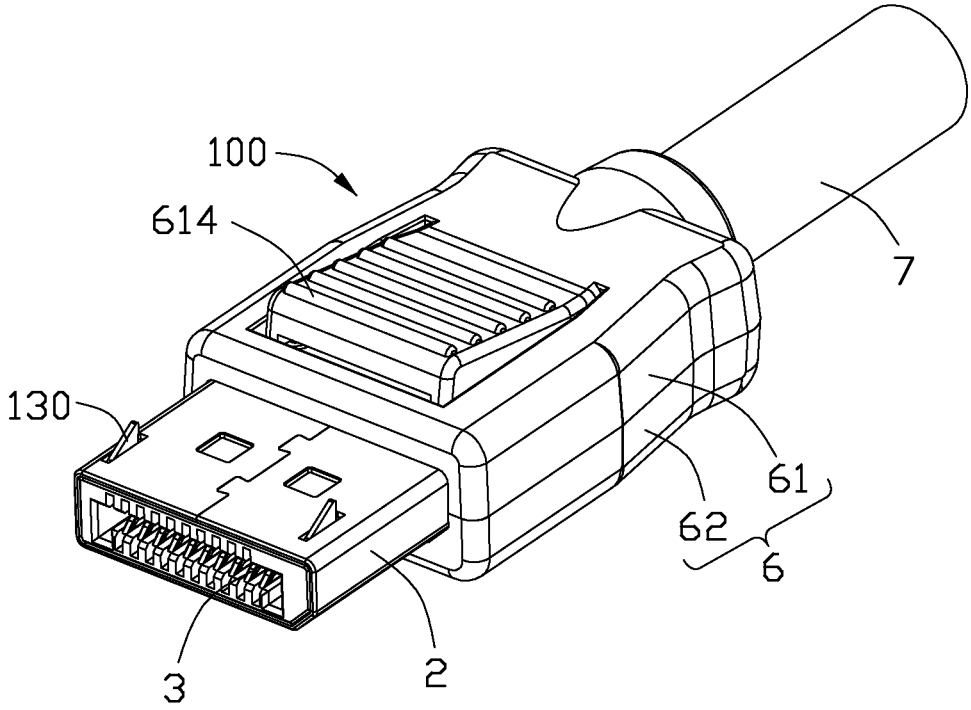
FIG. 1 is an assembled, perspective view of a cable assembly in accordance with the present invention.

Reference will now be made in detail to the preferred embodiment of the present invention.

Referring to FIGS. 1-9, a cable assembly 100 in accordance with the present invention comprises an insulated housing 2, a plurality of terminals 3 arranged on a spacer 4 and then together received in the insulated housing 2, a metallic plate 5 inserted into the spacer 4, a metallic shell 1 enclosing the insulated housing 2, a cable 7 electrically connected to the terminals 3, and a cover 6 partially shielded the metallic shell 1 and the cable 7.

Referring to FIGS. 2-5, the insulated housing 2 comprises a top wall 23, an opposite bottom wall 21, and a pair of side walls 22, 24 connecting with the top and the bottom walls 23, 21. The insulated housing 2 defines a receiving space 20 formed by the top wall 23, the bottom wall 21 and two side walls 22, 24. The top wall 21 and the bottom wall 22 respectively defines a plurality of terminal passages 25 formed on an inner surface thereof The top wall 23 and the bottom wall 21 respectively defines two spaced protruding portions 210 formed thereon. Each of protruding portions 210 defines a locking member 211 formed thereon. The top wall 23 defines two slits 230 formed on a top surface thereof Each of side wall 22, 24 defines a protrusive portion 231 formed on a rear end thereof.

Figure 2:
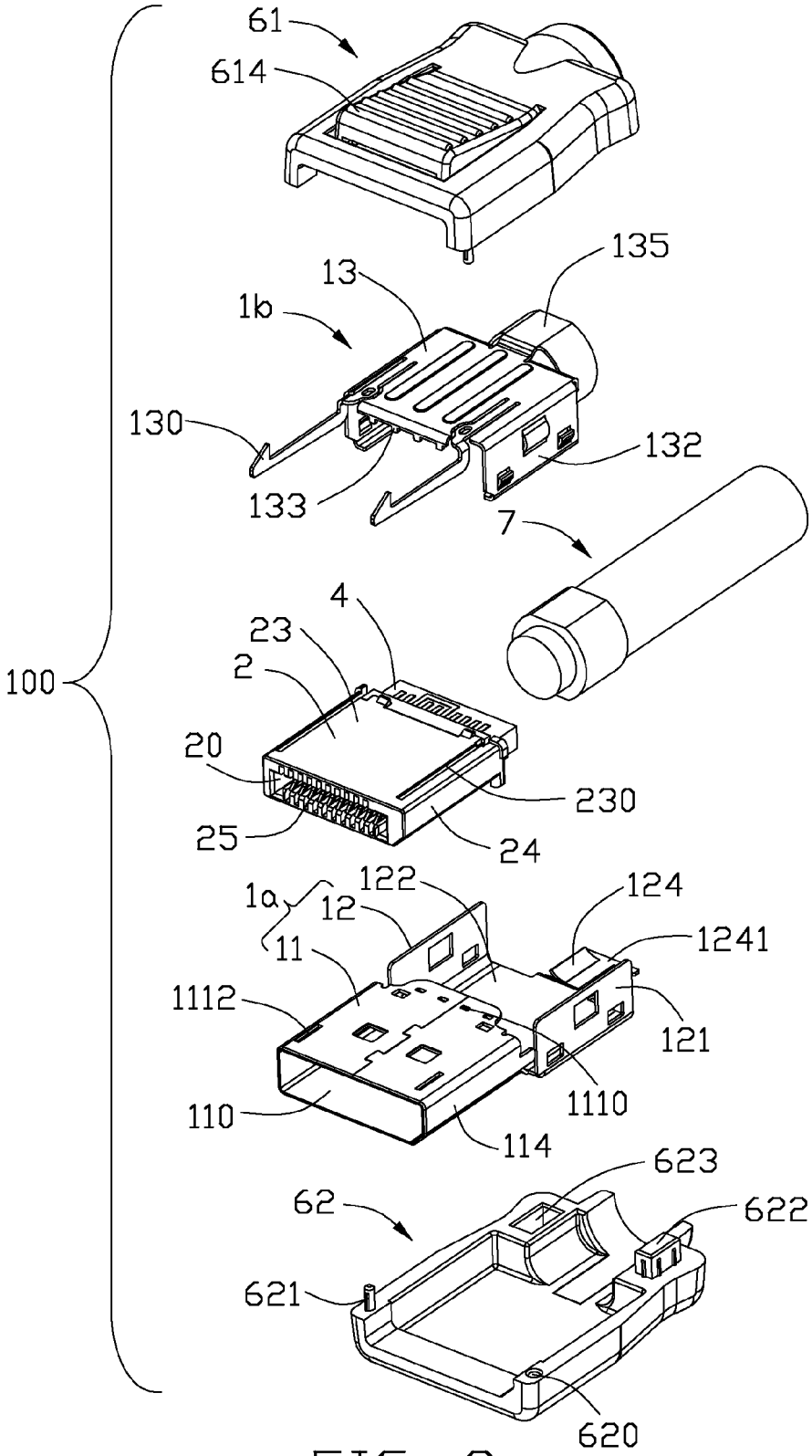
FIG. 2 is an exploded, perspective view of FIG. 1.
Figure 3:
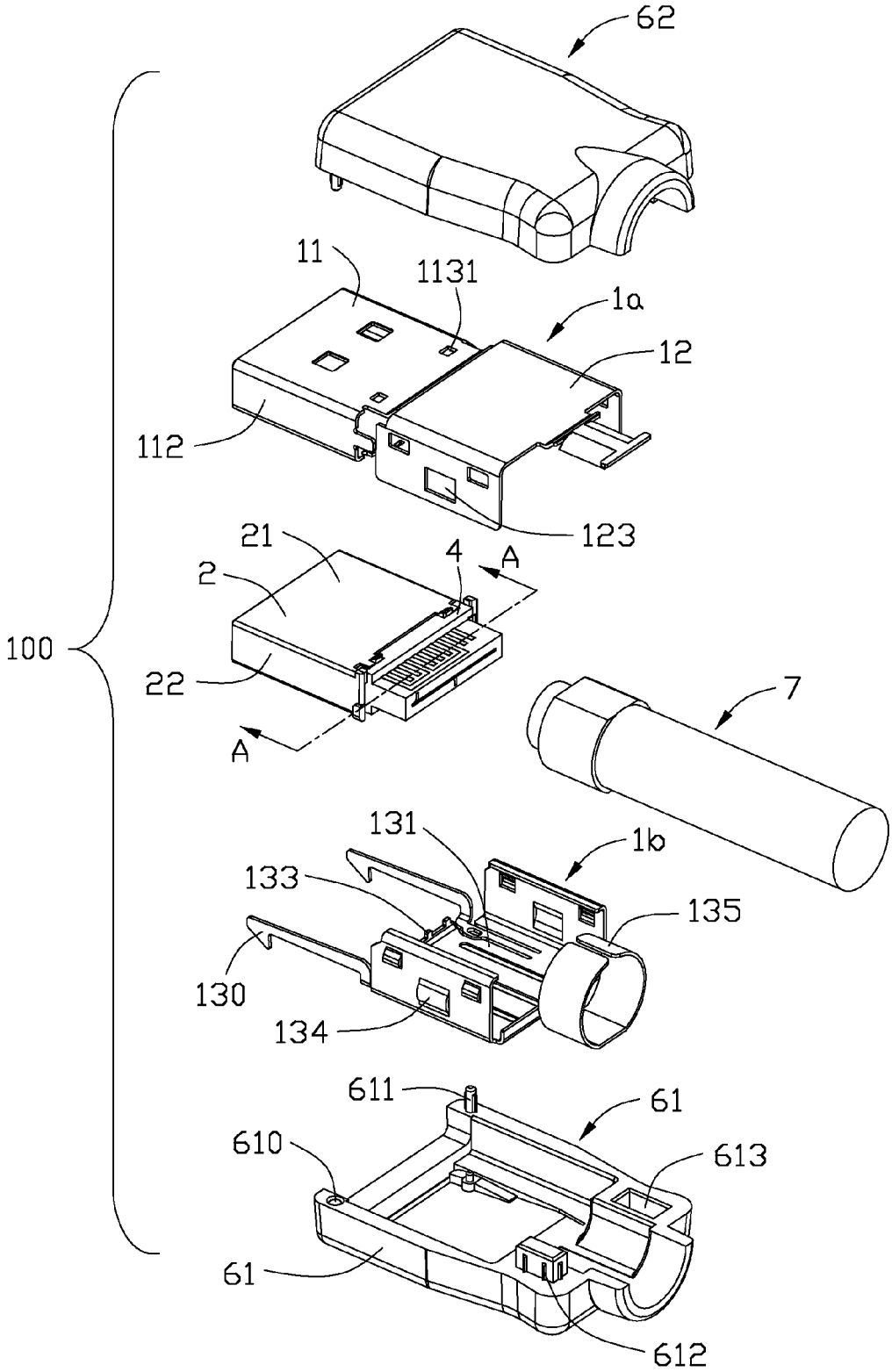
FIG. 3 is similar to FIG. 2, but viewed from another aspect.

Referring to FIGS. 1-3, the metallic shell 1 comprises a first shield portion 1*a* and a second shield portion 1*b* assembled with each other. The first shield portion 1*a* comprises a front frame portion 11 defining a bottom side 113, an opposite top side 111, and a pair of lateral sides 112, 114 connecting the top and the bottom sides 111, 113 to form a receiving room 110 for receiving the insulated housing 2. The top side 111 defines four holes 1110 formed on a rear section thereof And, the top and bottom sides 111, 113 respectively defines a pair of apertures 1131 formed thereof The top side 111 further defines two slots 1112 formed thereon. The first shield portion 1*a* further comprises a rear U-shaped portion 12 rearward extending from a lower side 113 of the front frame portion 11. The rear U-shaped portion 12 also comprises a bottom section 122 and a pair of side sections 121 extending upwardly from two sides of the bottom section 122 and a supporting section 124 extending rearward from a rear edge of bottom section 122. The supporting section 124 defines a flat section 1241 formed on a middle section formed thereof Each side section 121 of the rear U-shaped portion 12 defines three locking holes 123. The second shield portion 1*b* comprises a n-shaped portion 13 and a cable holder 135 extending rearwardly from a rear edge of the n-shaped portion 13. The n-shaped second portion 13 also comprises a top section 131, a pair of side sections 132 extending downwardly from two sides of the top section 131, and a pair of locking arms 130 extending forwardly from a front edge of the n-shaped portion 13. Each side section 132 defines three locking tabs 134 cooperated with three corresponding locking holes 123 of the side section 121 of the rear U-shaped portion 12. The top section 131 further defines four tabs 133 cooperated with four holes 1110.

Figure 4:
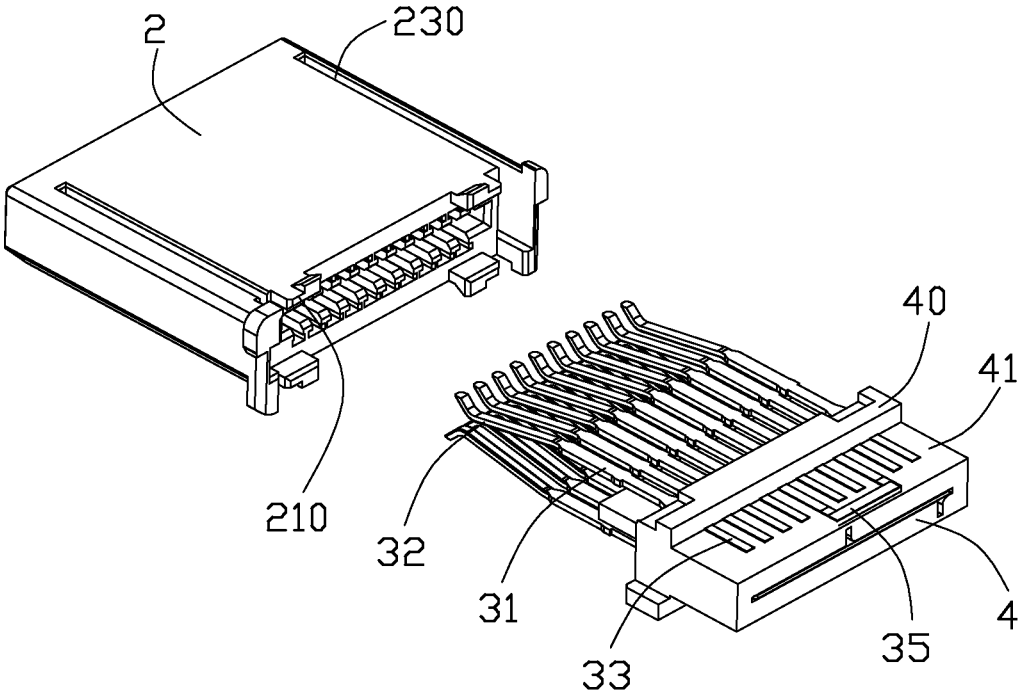
FIG. 4 is an exploded view of an insulated housing, a number of terminals, a spacer, and a metal plate of the cable assembly of FIG. 2.
Figure 5:
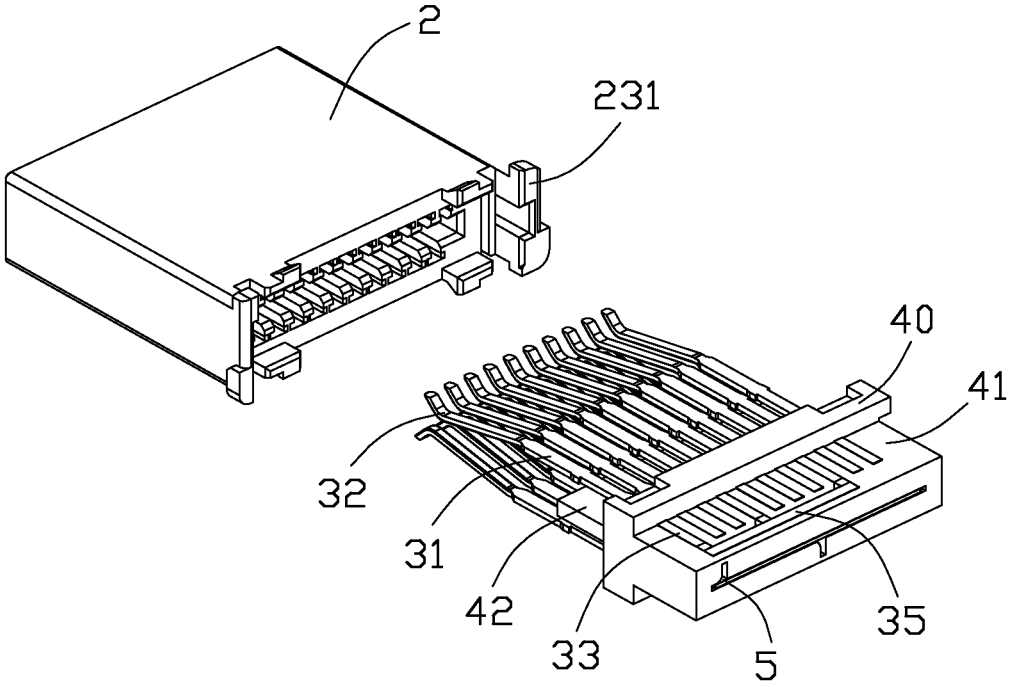
FIG. 5 is similar to FIG. 4, but viewed from another aspect.
Figure 6:
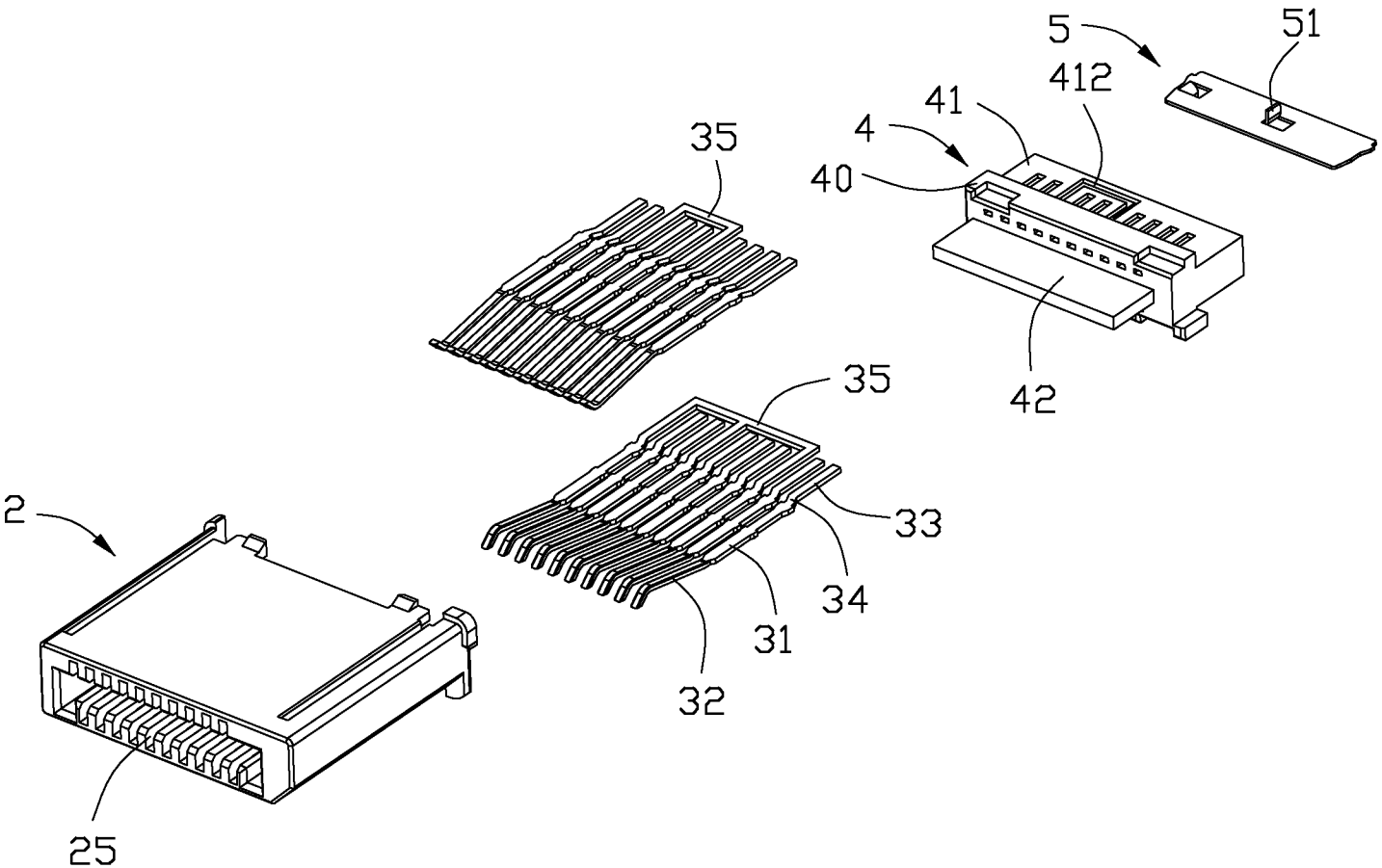
FIG. 6 is an explode, perspective view of FIG. 4.
Figure 7:
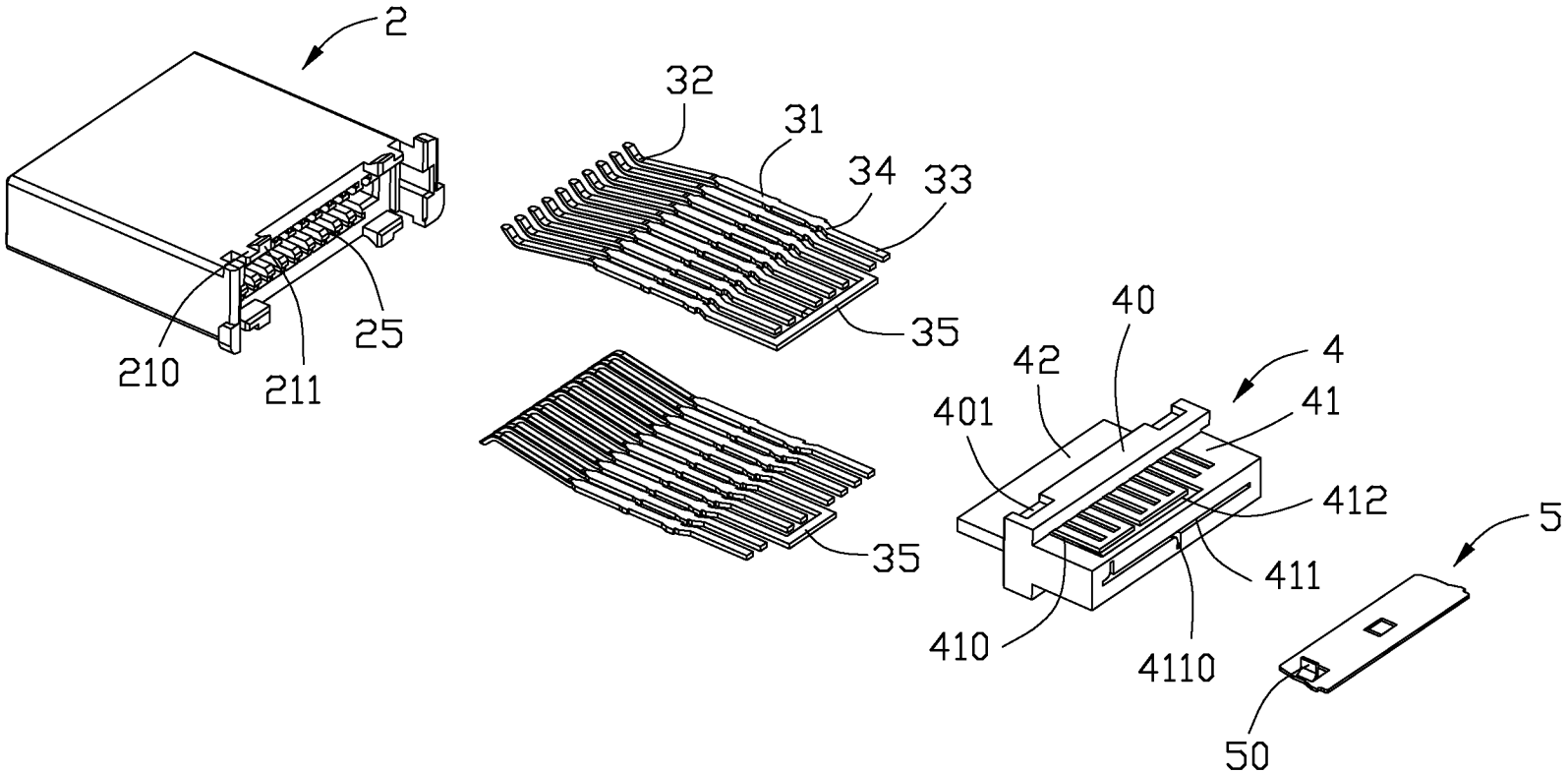
FIG. 7 is similar to FIG. 6, but viewed from another aspect.
Figure 8:
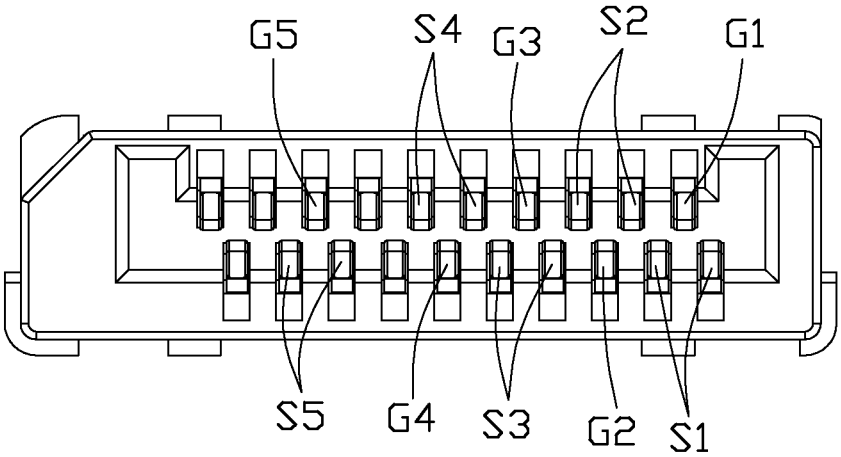
FIG. 8 is a front view of FIG. 5.
Figure 9:
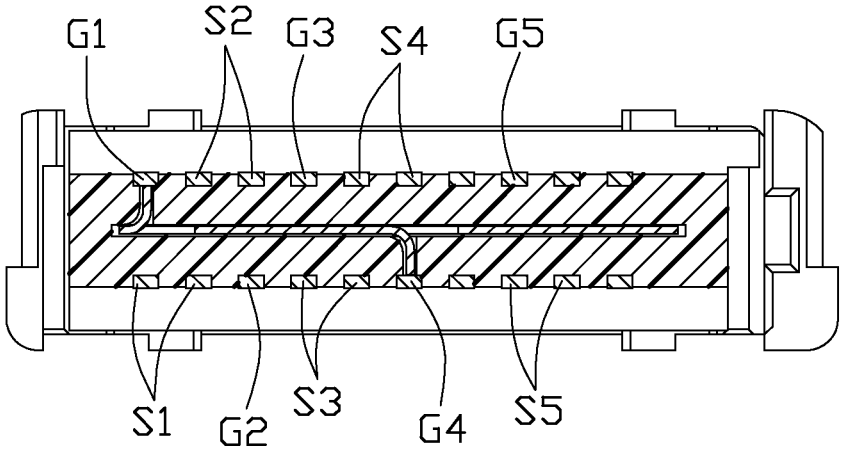
FIG. 9 is a cross-section view, take along line A-A of FIG. 3.

Referring to FIGS. 4-6, a plurality of terminals 3 are divided into an upper and a lower rows and accommodated in the insulated housing 2. Each terminal 3 with identical configuration comprises a flat body portion 31, a curved mating portion 32 extending forward from a front end of the body portion 31, and an terminating portion 33 extending rearwardly from a rear end of the body portion 31. The terminating portion 33 and the body portion 31 are located on a same horizontal plane. And the terminating portion 33 is deflected from the body portion 31 along a transversal direction perpendicular to a mating direction of the cable assembly 100. The terminal 3 further comprises a bending portion 34 connected with the body portion 31 and the terminating portion 33. The bending portions 34 of the upper row of terminals 3 extend along a left-to-right direction. And, the bending portions 34 of the lower row of terminals 3 extend along a right-to-left direction. Thus, the terminating portions 33 of the upper row of terminals 3 are respectively in alignment with the terminating portions 33 of the lower row of terminals 3 along a vertical direction.

Referring to FIGS. 4-9, a plurality of terminals 3 are divided into five terminal groups S1,G1; S2,G2; S3,G3; S4,G4; S5,G5. Each terminal group comprises a pair of differential signal terminals S1~S5 and a grounding terminal G1~G5. The pair of differential signal terminals S1~S5 are located in different rows of terminals 3, and the grounding terminals G1~G5 are also located in different rows of terminals 3. Two mating portions 32 of the pair of differential signal terminals S1~S5 are located on a same plane. Two mating portions 32 of a pair of differential signal terminals S1~S5 and a mating portion 32 of a grounding terminal G1~G5 are arranged into isosceles triangular configuration in a vertical plane. A terminating portion 33 of a grounding terminal G1~G5 and two terminating portions 33 of a pair of differential signal terminals S1~S5 are arranged into right-angled triangular configuration in a vertical plane.

Referring to FIGS. 4-9, the upper row of terminals 3 comprise a connecting piece 35 connected with the terminating portion 33 of the grounding terminals G2, G4 and extending along a transversal direction. The low row of terminals 3 also comprise another connecting piece 35 connected with the terminating portion 33 of the grounding terminals G1, G3, G5 and extending along a transversal direction.

Referring to FIGS. 4-5, the spacer 4 comprises a base portion 40, a tongue portion 42 extending forwardly from a front surface of the base portion 41, and a rear portion 43 extending rearward from a rear surface of the base portion 41. The base portion 40 defines two rows of channels 410 throughout the front and the rear face thereof and respectively extending to top and bottom surfaces of the rear portion 41. The rear portion 41 defines two connecting grooves 412 respectively formed on the top and bottom surfaces thereof and extending along a transversal direction. Each connecting groove 412 is located in back of the channels 410 and communicated with at least two channels 410 for receiving connecting piece 35 of the upper and lower row of terminals 3. The rear portion 41 further defines a receiving slot 411 depressed forwardly from a back surface thereof The receiving slot 410 defines two vertical slots 4110 respectively communicated with the two connecting groove 412. It should be noted that the plurality of terminals 3 are integrated with the spacer 4 through insert molding process.

Referring to FIGS. 5-6, the cable assembly 100 further comprises a metallic plate 5 received into the receiving slot 411 in the rear portion 43 of the spacer 4 and located between the upper an lower rows of terminals 3. The metallic plate 5 defines two vertical tabs 51, 52 extending along opposite direction.

Referring to FIGS. 1-3, the cover 6 comprises an upper cover 61 and a lower cover 62 assembled with the upper cover 61. The upper and lower cover 61, 62 respectively defines a mounting hole 610, 620 and a mounting posts 611, 621. The mounting hole 610 of the upper cover 61 is cooperated with the mounting post 621 of the lower cover 62. The mounting hole 620 of the lower cover 62 is cooperated with the mounting post 611 of the upper cover 61. The upper cover 61 and the lower cover 62 respectively defines a positioning post 612, 622 and a positioning groove 613, 623. The positioning post 612 of the upper cover 61 is cooperated with the positioning groove 623 of the lower cover 62. The positioning post 622 is cooperated with the positioning groove 613 of the upper cover 61. The upper cover 61 also defines a button 614 used to control locking arm 130 of the second shield part 1*b* moved along a vertical direction.

Referring to FIGS. 1-3, the cable 7 comprise a number of conductive wires (not shown) electrically connected with the terminating portions 33 of the plurality of terminals 3. The conductive wires comprise a plurality of signal wires and grounding wires.

Referring to FIGS. 1-10, the assembling process of the cable assembly 100 made in according to the present invention comprises following steps. Firstly, the plurality of terminals 3 are arranged into two rows and integrative formed with the spacer 4 through insert molding process. The body portions 31 of the terminals 3 are supported by the tongue portion 42. The mating portions 33 are located beyond a front surface of the tongue portion 42. The terminating portions 33 are received into the channels 410. And the two connecting pieces 35 are respectively received into in the two connecting grooves 412. Secondly, the metallic plate 5 is inserted into the receiving slot 410 of the spacer 4, with the two tabs 51, 52 respectively accommodated in the two vertical slots 4110 and respectively contacting with the connecting pieces 35. Thirdly, the terminals 3 and the spacer 4 are together assembled to the insulated housing 2 until the base portions 43 abutting against rear surface of the insulated housing 2. The mating portions 32 of the terminals 3 are received in the terminal passages 25 of the insulated housing 2. The tongue portion 42 of the spacer 4 is received in the receiving space 20. And the protruding potions 210 of the insulated housing 2 are received in the cutouts 401 of the base portion 40 of the spacer 4.

Fourthly, the conductive wires of the cable 7 are respectively soldered to the terminating portions 33 of the terminals 3. Fifthly, the insulated housing 2 is enclosed by the front frame portion 11 of the first shield portion 1*a* of the metallic shell 1. Thus, the pair of locking members 211 of the two protruding potions 210 of the insulated housing 2 are inserted into the pair of apertures 1131 of the rear section of the top side 113 of the frame portion 11. Simultaneously, the base portion 43 of the spacer 4 and the exposed wires are received into the rear U-shaped portion 12 of the first shield part 1*a*. Then second shield portion 1*b* is assembled to the first shield portion 1*a*. Thus, the tabs 133 of the top section 131 are passed through corresponding holes 1110 of the top side 111. The locking tabs 134 of the side section 132 of the second shield portion 1*b* are engaged with the locking holes 123 of the side section 121 of the first shield portion 1*a*. Sixthly, the cover 6 is assembled to the metallic shell 1.

After the above assembling steps, the entire process of assembling of the cable assembly 100 is finished. As the terminating portions 33 of the upper rows of terminals 3 are respectively in alignment with the terminating portions 33 of the lower rows of terminals 3 along a vertical direction, so a width between two terminating sections 33 of two lateral terminals 3 is short and narrow. Thus, the solder between the terminating section 33 and the wire will not short-circuit contact with inner side of metallic shell 1. And, more receiving space is formed in the cable assembly 100 for inner mold surrounding the terminating portions 33 of the terminals 3 entered therein. In additional, the terminating sections 33 of the upper and low rows of terminals 3 are spaced by a metallic plate 5. And the terminating portions 33 of the grounding terminals G2, G4 of the upper rows of terminals 3 are connected with each other by one connecting piece 35. The terminating portions 33 of the grounding terminals G1, G3, G5 of the lower rows of terminals 3 are connected with each other by another connecting piece 35. As, the metallic plate 5 contact with the two connecting pieces 35, so all grounding terminals G1~65 are commonly grounded. Thus, the grounding conductive wires of cable 7 is easily electrically connected with the grounding terminals G1~G5 through connecting piece 35. Due to the new arrangement of the terminals 3, the cable assembly 100 also has improved crosstalk performance.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. A cable assembly comprising:

a housing defining a receiving space;

a spacer assembled to a rear end of the housing;

a plurality of terminals integrated with the spacer, and arranged into two rows and received into the housing, and each row of terminals comprising at least two grounding terminals and a connecting piece connecting with rear ends of at least two grounding terminals;

a metallic plate received into the spacer and contacted to the connecting piece; and a cable electrically connected with the plurality of terminals.

2. The cable assembly as claimed in claim 1, wherein each terminal defines a front mating portion, a rear terminating portion and a body portion connecting with the front mating portion and the rear terminating portion.

3. The cable assembly as claimed in claim 2, wherein the plurality of terminals are divided into several terminal groups, each terminal group comprising a pair of differential signal terminals and a grounding terminal located on two rows of terminals.

4. The cable assembly as claimed in claim 3, wherein the mating portions of the pair of signal terminals and the mating portion of the grounding terminal of each terminal group are arranged into an isosceles triangular configuration in a vertical plane.

5. The cable assembly as claimed in claim 4, wherein the two terminating portions of the pair of signal terminals and the terminating portion of the grounding terminal of each group are arranged into right-angled triangular configuration in a vertical plane.

6. The cable assembly as claimed in claim 2, wherein the terminating portion of each terminal is offset from the mating portion and the body portion along a transversal direction.

7. The cable assembly as claimed in claim 2, wherein the terminating portions of the upper row of terminals are respectively in alignment with the terminating portions of the lower row of terminals along a vertical direction.

8. The cable assembly as claimed in claim 1, wherein the spacer defines a receiving slot, the metallic plate is accommodated in the receiving slot and located between two rows of terminals.

9. The cable assembly as claimed in claim 8, wherein the metallic plate defines two vertical tabs extending along two opposite directions and respectively contacted with the connecting piece.

10. The cable assembly as claimed in claim 1, wherein the cable assembly further comprises a metallic shell enclosing the housing and a cover partially shielding the metallic shell and the cable.

11. The cable assembly as claimed in claim 10, wherein the metallic shell comprises a first shield part and second shield part assembled with each other.

12. The cable assembly as claimed in claim 2, wherein the housing defines two rows of terminal passages formed therein and communicated with the receiving space, and the mating portions of the plurality of terminals are received into the terminal passages.

13. The cable assembly as claimed in claim 1, wherein the spacer defines a base portion and a tongue portion extending forwardly from a front surface of the base portion and received into the receiving space.

14. A cable connector assembly comprising:

an insulative housing defining a mating port;

two rows of contacts disposed in the housing and side by side arranged with one another along a transverse direction, each of said contacts defining, in a front-to-back direction perpendicular to said transverse direction, a front contacting section exposed to the mating space and a rear tail section exposed outside of the housing, said contacts including signal contacts and grounding contacts somewhat alternately arranged in said transverse direction;

a connecting piece connecting the selective grounding contacts around the corresponding tail sections; and a grounding/shielding plate extending in the transverse direction and interposing said two rows of contacts, in a vertical direction perpendicular to both said transverse direction and said front-to-back direction, around the tail sections; wherein said grounding/shielding plate and said connecting piece are directly mechanically and electrically connected to each other around the tail sections.

15. The cable connector assembly as claimed in claim 14, wherein said connecting piece is unitarily formed with the corresponding grounding contacts.

16. The cable connector assembly as claimed in claim 14, further including a spacer located one rear side of the housing to support the tail sections of the contacts and hold the connecting piece and the grounding/shielding plate therein.

17. The cable connector assembly as claimed in claim 14, wherein said grounding/shielding plate defines the tab extending toward the connecting piece for contact.

18. The cable connector assembly as claimed in claim 17, wherein said tab extends in the vertical direction.

19. The cable connector assembly as claimed in claim 18, wherein said spacer is integrally formed with the tail sections of the contacts.

20. The cable connector assembly as claimed in claim 19, wherein said spacer defines a horizontal groove with a rear opening to allow the grounding/shielding plate to be forwardly inserted thereinto via said rear opening.

* * * * *